United States Patent [19]

Hornung

[11] Patent Number: 4,749,179

[45] Date of Patent: Jun. 7, 1988

[54] APPARATUS FOR INTRODUCING MARKING STRIPS INTO SHEET STACKS

[75] Inventor: Hans Hornung, Alsbach, Fed. Rep. of Germany

[73] Assignee: Valmet-Strecker GmbH, Pfungstadt, Fed. Rep. of Germany

[21] Appl. No.: 924,042

[22] Filed: Oct. 28, 1986

[30] Foreign Application Priority Data

Apr. 11, 1985 [DE] Fed. Rep. of Germany ..... 3539099

[51] Int. Cl.[4] ..... B65H 45/22

[52] U.S. Cl. ..... 270/95; 83/280; 414/289

[58] Field of Search ..... 270/95; 209/652–654; 83/279–280

[56] References Cited

U.S. PATENT DOCUMENTS

| | | | |
|---|---|---|---|
| 3,205,739 | 9/1965 | Meyer-Jagenberg | 270/95 |
| 3,458,186 | 7/1969 | Schmidt | 270/95 |
| 4,396,336 | 8/1983 | Malamood | 270/95 |
| 4,624,452 | 11/1986 | Pulsakamp | 270/95 |
| 4,639,177 | 1/1987 | Meratti | 270/95 |

*Primary Examiner*—E. H. Eickholt

*Attorney, Agent, or Firm*—Karl F. Milde, Jr.

[57] ABSTRACT

Apparatus for the frontal introduction of marking strips (24), which are automatically formed, into a sheet stack (26) comprises a strip feeding device (18, 74–90) for supplying the marking strips (24) from a supply roll (20); a tongue (36) which is moved frontally into the sheet stack profile, lowered onto the stack (26), raised again and then retracted from the stack under the next deposited sheet (100); a guide channel (90) for the strip (22) supplied by the strip feeding device which opens into a gap under the lowered tongue (36); and a severing device (92) for severing the introduced marking strip (24) from the strip supply. The tongue (36) has downwardly bent flanks (40) that form a flat wedge, the guide channel (90) thereby opening into the channel (42) inside the tongue. The tongue is retracted in a loop-like movement while it is being slightly raised. It is then lifted upward before being moved in again while, for the most part, remaining outside the stack profile. The subject apparatus may be used on the front side (the side opposite the sheet supply side) of a stacker (6) having guide belts (28) running over it which leave little free space above the stack.

9 Claims, 3 Drawing Sheets

APPARATUS FOR INTRODUCING MARKING STRIPS INTO SHEET STACKS

BACKGROUND OF THE INVENTION

The present invention relates to an apparatus for the frontal introduction of marking strips during the formation of stacks of sheets, such as paper sheets.

When depositing sheets, in particular sheets of paper, in a sheet stacking device it is customary to place marking strips between counted quantities of sheets, referred to as "reams", to facilitate the identification and removal of individual reams, for instance for separately packing these reams. The reams are normally fed to the packing machine frontally away from the stack, for which purpose the respective stack, lying on a lift table, is placed againt a fixed vertical butt plate of the machine. For the transfer of each ream into the packing machine, the operator introduces an "air knife" into the stack under the respective marking strip and thereby pushes the ream lying thereon into the packing machine. This procedure presupposes that the marking strips appear on the front of the stack opposite the butt plate, although the feeding of sheets to the stack inside the stacking device occurs frontally. Considering that the stacks usually lie on a pallet flush with a front side and that, for technological reasons, this front side—the same which later will apply against the butt plate of the packing machine—is the one from which the sheets were supplied to the stack, the marking strips must be introduced into the stack on the side opposite the front side.

In the apparatus of the type known from Belgian Pat. No. 778,307, the marking strip inserting tongue moves in above the stack approximately horizontally, then drops onto the stack by its free end, in order to form below the following sheet a wedge-shaped gap, into which the marking strip enters. It then rises again into a substantially horizontal position in order then to withdraw from the stack profile without interfering with the injected strip. Although this known apparatus functions satisfactorily, it is unusable where, as is presently customary, sheet feeding to the stack occurs under guide belts that pass over the stack since these guide belts leave no room for the respective tongue movement inside the stack profile. If the height of the gap formed by the tongue in the stack is reduced to a few millimeters, as would be necessary in this case, there is a danger that, on the one hand, the marking strip may miss the gap which is no longer exactly controllable and, on the other hand, that the withdrawing tongue may entrain and draw back with it a properly injected marking strip.

SUMMARY OF THE INVENTION

It is therefore the object of the present invention to provide apparatus of the above-mentioned type which can be used in a satisfactory manner in conjunction with a stacking device of the type having guide belts extending over the stack.

This object as well as other objects which will become apparent from the discussion that follows, are achieved, according to the invention, by providing apparatus which comprises:

(a) a strip feeding device for supplying the marking strips from a strip supply roll, this strip feeding device including a guide channel for receiving and guiding the strips supplied from the roll;

(b) a tongue for inserting these strips into the stack of sheets, the tongue having downwardly bent, wedged-shaped flanks forming a channel for the receipt of the strip from the guide channel;

(c) a device, arranged between the guide channel and the tongue, for severing the strip supplied to the tongue from the strip in the guide channel; and (d) an arrangement, coupled to the tongue, for moving the tongue frontally into the stack profile from a starting point above the stack of sheets, lowering the tongue onto the stack, retracting the tongue from the stack with a loop-like movement while the tongue is slightly lifted, and then raising the tongue to its starting point again while the tongue remains substantially outside the stack profile.

The lateral angular bends of the tongue ensure a shallow gap, but sufficient for insertion of the strip, the inserted strip being furthermore sheilded from the air escaping under the following sheet by the channel under the tongue which is enclosed on three sides. The slight lifting of the tongue before its withdrawal ensures that the inserted strip is not pushed back by th tip of the tongue. The subsequent further lifting of the tongue outside the stack before it is introduced again makes it possible to let the tongue come to rest on the stack with certainty, before the subsequently deposited sheets prevent the tongue from being lifted above the guide belts that pass over the stack.

For a full understanding of the present invention, reference should now be made to the following detailed description of the preferred embodiment of the invention and to the accompanying drawings.

DESCRIPTION OF THE PREFERRED EMBODIMENT

Figure 1:
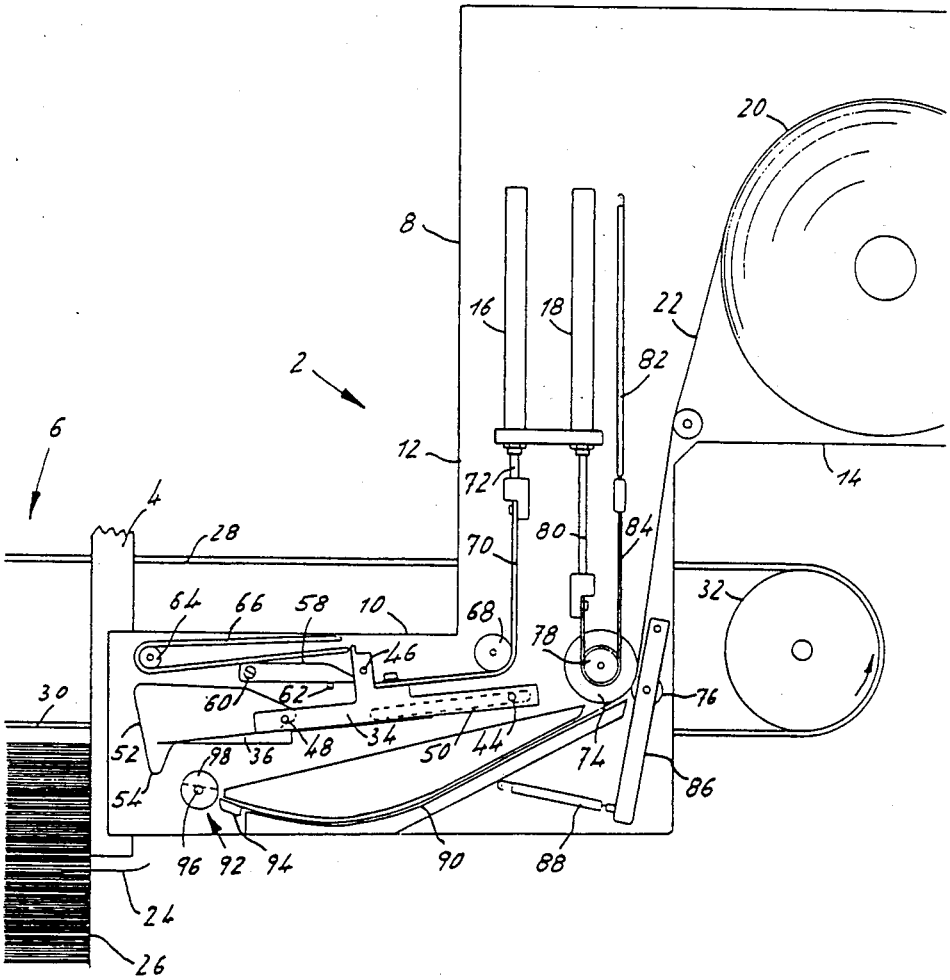
FIG. 1 shows a somewhat schematic vertical section through the essential parts of the respective apparatus according to the present invention and a contiguous portion of the respective stacker with the stack being formed therein.

The preferred embodiment of the present invention will now be described with reference to FIGS. 1–5 of the drawings. Identical elements in the various figures are designated with the same reference numerals.

The apparatus 2 according to the present invention comprises a housing 8 attached, in a manner not shown in detail, on the frontal abutment plate 4 of a sheet stacker 6. For example, the housing may be hooked on to the abutment plate 4. The housing 8 comprises a horizontal leg 10, a vertical leg 12 contiguous with, and extending upwardly from the rear of the horizontal leg 10, and a widened section 14 contiguous with and extending rearwardly from the upper part of the vertical leg 12. The vertical leg 12 receives two vertically extending, relatively long-stroke pneumatic cylinders 16 and 18, while the widened section 14 contains a supply roll 20 of a paper strip 22, from which the marking strips 24 are severed as pieces, for example, of about 80 mm in length. Extending over the stack 26, which builds up on an automatically lowerable table (now shown) of the stacking device 6, are a plurality of a parallel, endless, driven, guide belts 28, mutually separated laterally by a distance of, for example, 40 mm. The lower strands 30 of these belts pass through the abutment plate 4, the belts being guided around a guide roller 32 beyond the abutment plate. The legs 10 and 12 of housing 8 penetrate between adjacent guide belts 28.

Figure 5:
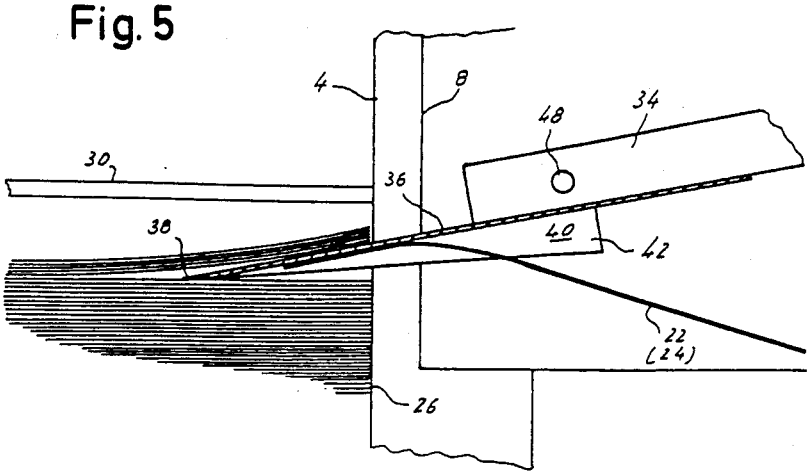
FIG. 5 is an enlarged detailed representation of a part of the apparatus shown in FIG. 3.

A slide 34 is guided in the horizontal leg 10 by means of a "link motion" arrangement. At the end of the slide, facing the stack 26, there is provided a tongue 36 with a pointed tip 38 (FIG. 5). The tongue 36 has a channel-like profile with two lateral, downwardly bent, wedge-shaped flanks 40. The paper strip 22 enters into stack 26 through the respective channel 42 formed by these flanks, as can be seen from FIG. 5.

More specifically, the slide 34 has three guide pins 44, 46 and 48. The rear guide pin 44 slides in an approximateley horizontal slot 50 of the housing 8, while the pin 48 nearest the stack 26 moves in an enlarged cutout 52 of housing 8. As can be seen from FIGS. 1 to 4, the cutout 52 has, on its underside at its end facing stack 26, a nose-like bulge 54 and, contiguous thereto and extending toward the rear, a guiding edge 56 approximately aligned with the slot 50. The pin 46 is able to slide over a switch tongue 58 which, at its end toward the stack 26 is mounted in the housing 8 by means of an axle bolt 60. A coil spring 66 passed around a guide roller 64 biases the slide 34 toward the stack 26, while the rear of the slide is engaged by a belt 70 that extends around a guide roller 68 and is connected to the piston rod 72 of a cylinder 16. This arrangement permits the slide 34 to be drawn away from the stack, counter to the force of the spring 66, by actuating the cylinder 16.

The paper strip 22 is pulled off the supply roll 20 by a feed roller 74 which mates with an opposite contact roller 76. The feed roller 74 is operatively connected to a coaxial drive roller 78, around which is looped a belt 84. This belt is fastened to the piston rod 80 of the cylinder 18 and is maintained under tension by a coil spring 82 attached to its other end. The contact roller 76 is normally pressed against the feed roller 74. In this way the feed roller 74 can, by actuation of the cylinder 18, be rotated by a certain angular distance, the paper strip 22 being thereby transported a corresponding linear distance of, for example, 80 mm. The advanced portion of strip 22 thus moves through a guide channel 90 formed in the horizontal housing leg 10, and through a severing device 92 at the end of the guide channel, into the channel 42 formed under the tongue 36 (FIGS. 3 and 5).

The severing device 92 consists essentially of a fixed cutter blade 94, on which the paper strip 22 rests, and a counter-blade 98 disposed above the paper strip which pivots about an axis 96. Counter-blade 98 and lever 86 are connected, in a manner not shown, with time-controlled drive means, having cams moved, for example, by the slide 34. As will be evident more exactly from the following description of the operation of the apparatus, the drive means actuate the severing device 92 at the proper moment and lift the contact roller 76 off the feed roller 74 during the return movement of the piston rod 80.

Figure 2:
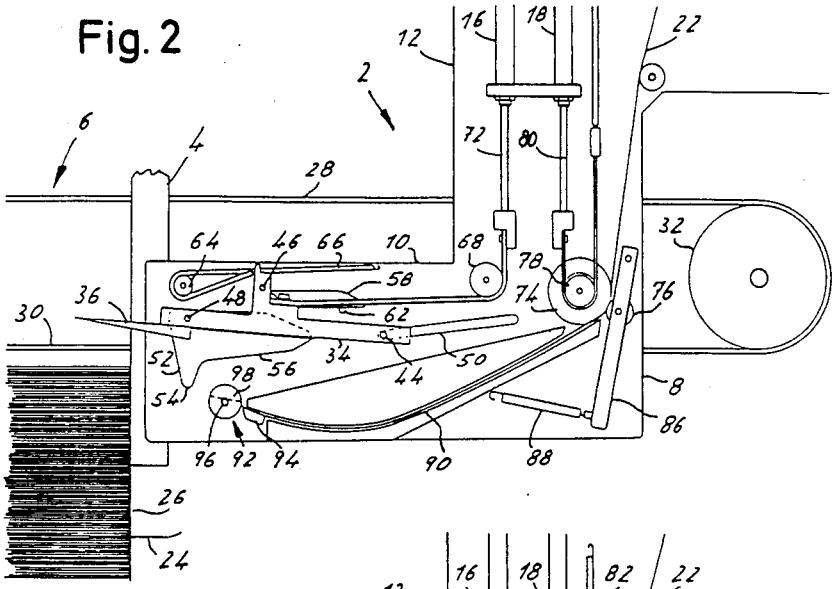
FIGS. 2, 3 and 4 are similar representations of the same parts as in FIG. 1, in successive later stages of operation.

FIG. 1 shows the respective apparatus 2 in the starting position. The apparatus 2 goes into operation when, upon introduction of the sheets into the stacker 6, a counting device determines the quantity corresponding to one ream, following insertion of the last-introduced marking strip 24. Initially, the piston rod 72 moves downward, permitting the spring 66 to pull the slide 34 forward. When this occurs, the pin 46 slides onto the switch tongue 58, so that the front end of the slide, together with the tongue 36, is lifted. At end of the stroke of the piston rod 72, the tongue 36 is above the stack 26, or more precisely, still above the lower belt strands 30, thereby making sure that the tongue 36 can place itself onto the stack from above (FIG. 2). However at the same time, at the end of this stroke, the switch tongue 58 has released the pin 46, permitting the front end of slide 34 with the tongue 36 to fall down so that the tongue rests on the stack. The pin 48 will then find room in the nose-like buldge 54.

Figure 3:
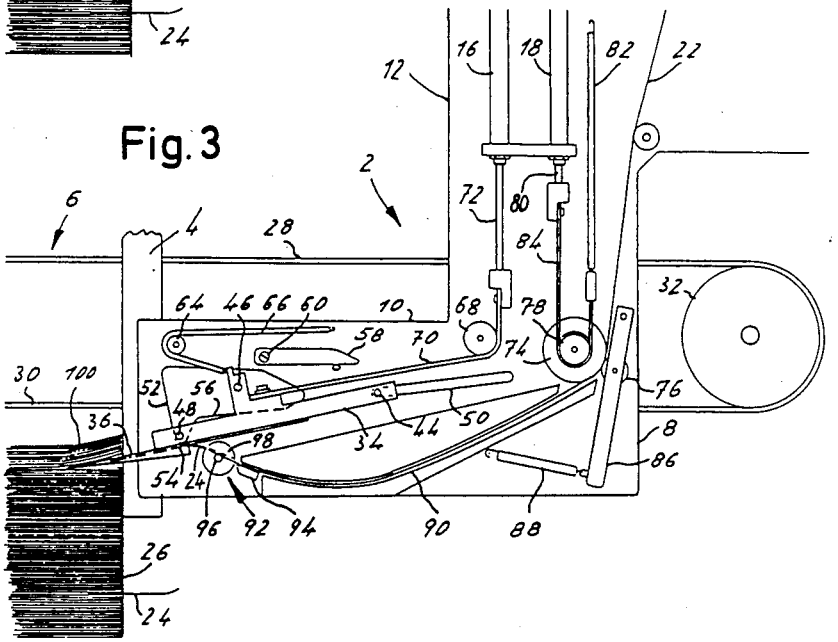

FIG. 3 shows the situation a little later, when subsequent sheets 100 have already accumulated above the tongue 36. As can be seen more particularly from FIG. 5, the tongue 36 here forms a wedge-shaped gap in the stack 26. The width of this gap is determined mainly by the downwardly bent flanks 40 of the tongue.

It must be noted at this point that the top sheets of the stack at first always rest relatively loosely one on the other, since they float on an air between them. For this reason it is important that the flanks 40 compress the sheets which lie below them, so that the mentioned channel 42 is kept free on the underside of the tongue. At the same time the flanks 40 shield the interior of the channel against the air escaping under the stacked sheets 100. As indicated in FIG. 5, the paper strip 22 can now enter this channel undisturbed. This occurs due to the fact that the cylinder 18 pulls the piston rod 80 upward, while at the same time the contact roller 76 is applied against the feed roller 74, thus causing the paper strip 22 to be pushed forward. The end of this process can be seen in FIG. 3.

Thereafter, the piston rod 72 of the cylinder 16 is pulled upward again, so that the slide 34, together with the tongue 36, moves back. But right at the beginning of this process, the pin 48 slides over the guide edge 56, thereby raising somewhat the front end of the slide with the tongue. This prevents the withdrawing tongue from taking with it the paper strip 22 injected into the stack 26 below. Instead, the end of the paper strip is now clamped by the stack.

Figure 4:
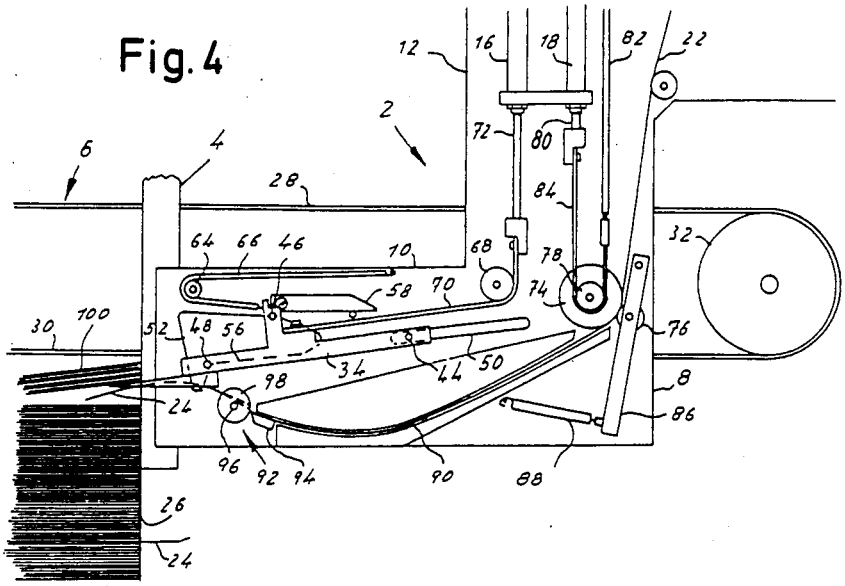

Next, the severing device 92 goes into operation to cut off the respective end of the paper strip, as a marking strip 24, from the rest of the paper strip. Immediately thereafter the contact roller 76 is lifted off the feed roller 74, while the piston rod 80 of the cylinder 18 rturns to its extended (downward) starting position. This stage is shown in FIG. 4. Shortly thereafter the described parts again occupy their starting position according to FIG. 1, and then also the contact roller 76 is again applied against the feed roller 74.

There has thus been shown and described a novel apparatus for frontally introducing marking strips into a stack of sheets, which apparatus fulfills all the objects and advantages sought therefor. Many changes, modifications, variations and other uses and applications of the subject invention will, however, become apparent to those skilled in the art after considering this specification and the accompanying drawings which disclose the preferred embodiment thereof. All such changes, modifications, variations and other uses and applications which do not depart from the spirit and scope of the invention are deemed to be covered by the invention which is limited only by the claims which follow.

What is claimed is:

1. Apparatus for frontally introducing marking strips into a stack of sheets as the stack is being formed, said apparatus comprising, in combination:

(a) strip feeding means for supplying the marking strips from a strip supply roll, said strip feeding means including a guide channel for receiving and guiding the strip supplied from said roll;

(b) a tongue for inserting said strips into said stack of sheets, said tongue having downwardly bent, wedge-shaped flanks forming a channel for the receipt of said strip from said guide channel;

(c) means, disposed between said guide channel and said tongue, for severing the strip supplied to said tongue from the strip in said guide channel; and (d) means, coupled to said tongue, for moving said tongue frontally into the stack profile from a starting point above the stack of sheets, lowering said tongue onto said stack, retracting said tongue from said stack with a loop-like movement while said tongue is slightly lifted, and raising said tongue to said starting point again while said tongue remains substantially outside the stack profile.

2. The apparatus defined in claim 1, wherein said tongue moving means includes a "link motion" guide for guiding the motion of said tongue.

3. Apparatus defined in claim 2, wherein said link motion guide comprises, on the one hand, a loop type guide part and, on the other hand, a straight guide part.

4. Apparatus defined in claim 2, wherein said link motion guide comprises a switch tongue.

5. Apparatus defined in claim 1, wherein said tongue moving means includes a main drive cylinder.

6. Apparatus defined in claim 5, wherein said main drive cylinder is a single-action cylinder and said tongue moving means further includes a return spring.

7. Apparatus defined in claim 5, wherein the movement of said main drive cylinder is redirected from a substantially vertical movement, by way of an elongate flexible strip, to a substantally horizontal movement.

8. Apparatus defined in claim 1, wherein said severing means includes a knife blade and means for pivoting said knife blade about a transversely extending axis.

9. Apparatus defined in claim 8, wherein said pivoting means moves said knife blade in response to movement of said tongue.

* * * * *